United States Patent [19]

Clark, Jr. et al.

[11] Patent Number: 4,501,569

[45] Date of Patent: Feb. 26, 1985

[54] SPHERICAL VEHICLE CONTROL SYSTEM

[76] Inventors: Leonard R. Clark, Jr., 128 Weldy Ave., Oreland, Pa. 19075; Howard P. Greene, Jr., 31 S. Main St., Schwenksville, Pa. 19473

[21] Appl. No.: 460,930

[22] Filed: Jan. 25, 1983

[51] Int. Cl.[3] ..... A63H 29/22; A63H 30/04; A63H 17/36

[52] U.S. Cl. ..... 446/458; 446/456; 446/460; 446/267; 180/21; 280/206

[58] Field of Search ..... 46/207, 254, 256, 262, 46/251, 252, 253; 280/205, 206, 207, 220, 221; 180/21; 446/456, 458, 460, 462

[56] References Cited

U.S. PATENT DOCUMENTS

| | | | |
|---|---|---|---|
| 933,623 | 9/1909 | Cecil | 46/207 |
| 1,033,077 | 7/1912 | Ayers | 46/207 |
| 1,039,617 | 9/1912 | Tyler | 46/207 |
| 3,777,835 | 12/1973 | Bourne | 280/207 |
| 4,391,224 | 7/1983 | Adler | 46/254 |

*Primary Examiner*—F. Barry Shay

*Attorney, Agent, or Firm*—Brady, O'Boyle & Gates

[57] ABSTRACT

A spherical vehicle including a spherical shell having a drive shaft secured to the interior wall thereof. A drive motor is connected to the shaft for imparting a rolling motion to the spherical vehicle on a supporting surface. Continuous steering of the vehicle is accomplished by changing the position of a mass suspended from the drive shaft to thereby change the center of gravity of the vehicle.

9 Claims, 10 Drawing Figures

FIG. 5
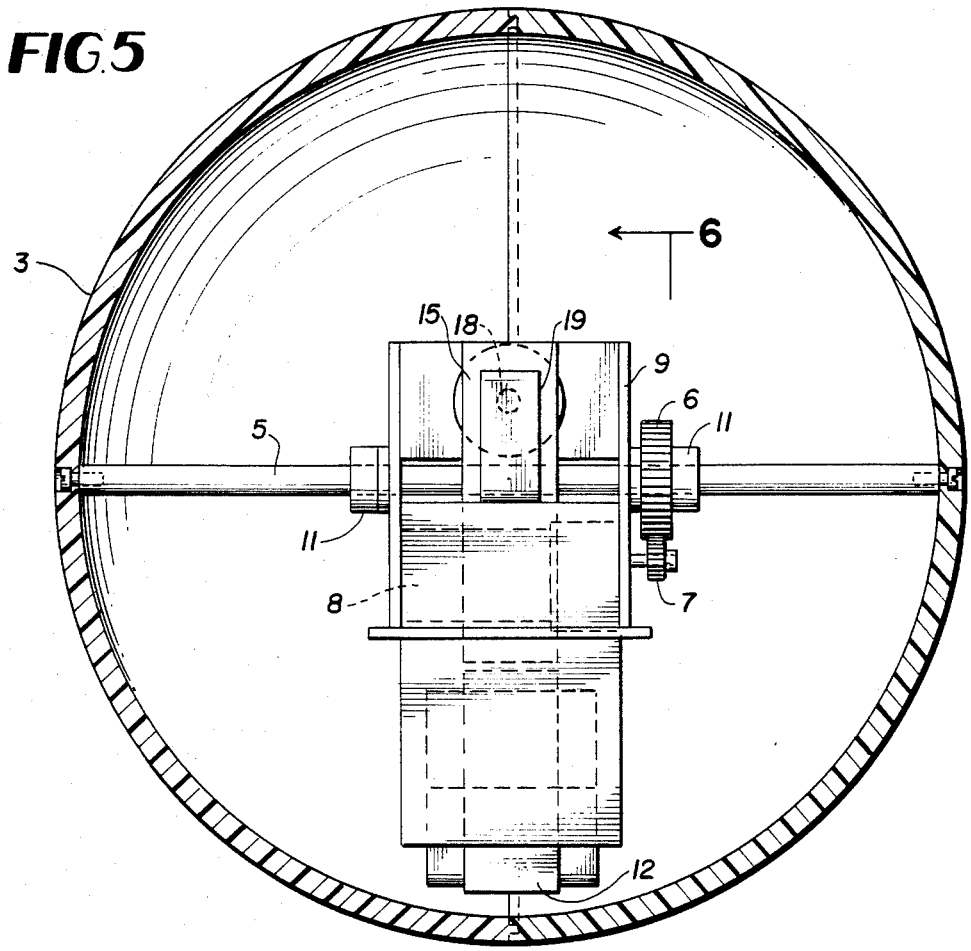
FIG. 6
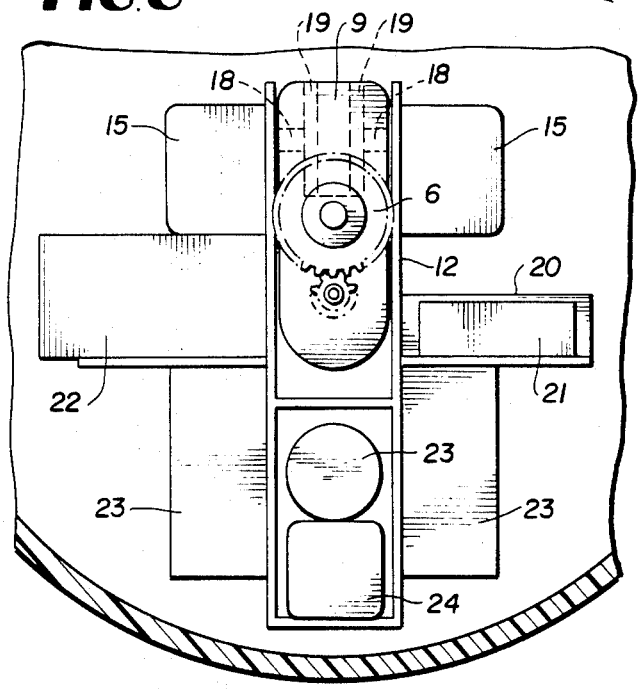
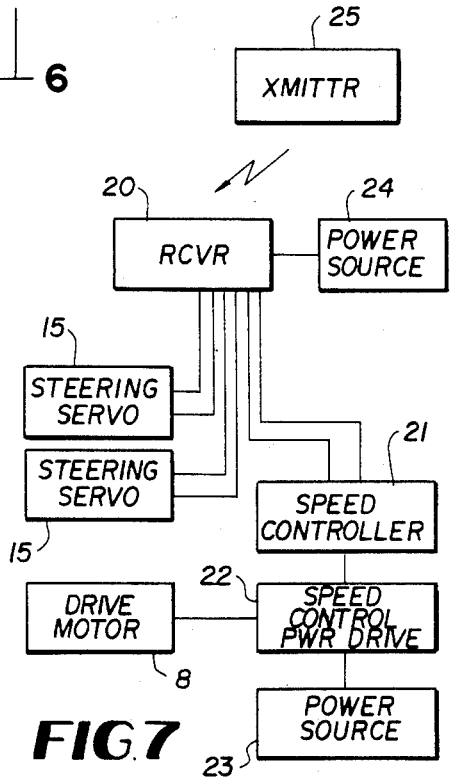
FIG. 7

FIG.8
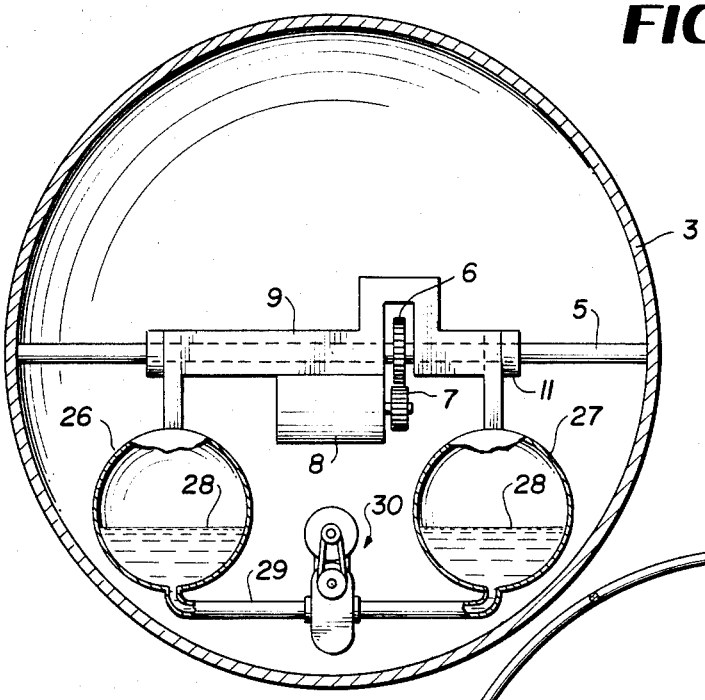
FIG.9
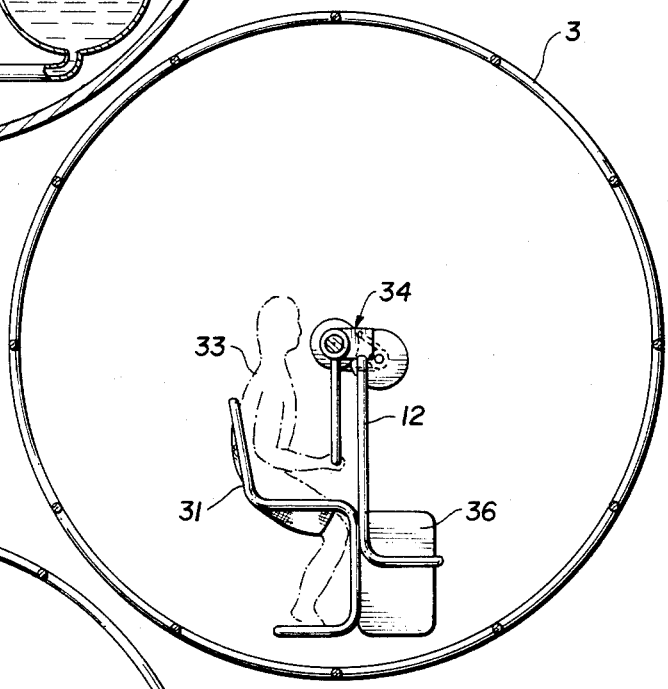
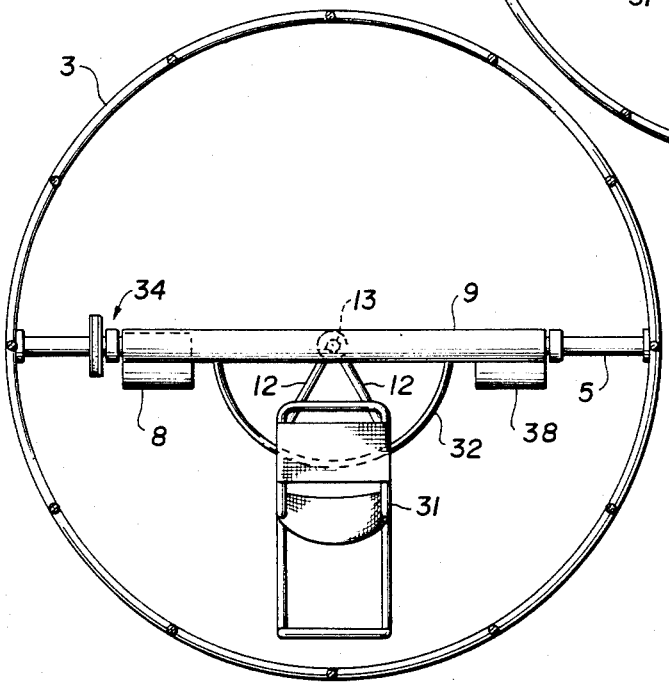
FIG.10

SPHERICAL VEHICLE CONTROL SYSTEM

BACKGROUND OF THE INVENTION

Spherical vehicles of the type having a drive shaft fixed at its opposite ends to the interior wall of a spherical shell and driven by a motor and gear assembly operatively connected to the drive shaft are known, as evidenced by U.S. Pat. Nos. 819,609 to Shorthcuse dated May 1, 1906; 2,949,696 to Easterling dated Aug. 23, 1960; and 2,949,697 to Licitis dated Aug. 23, 1960. Patent 819,609 further discloses the concept of suspending a mass from the drive shaft and manually inclining the mass to the axis of the shaft to cause the spherical member to travel in a curved path.

Heretofore, the spherical vehicles noted above either had no provision for steering the vehicle, or in the case of the Shorthcuse vehicle, the direction of travel is controlled by manually moving the mass to thereby maintain the vehicle in a fixed direction of travel until the vehicle is stopped and the mass is manually shifted to another position, whereby the vehicle will roll in another fixed direction of travel.

After considerable research and experimentation, the spherical vehicle of the present invention has been devised wherein a steering system is provided which can be continuously controlled to determine the direction of travel of the spherical vehicle while it is rolling on a supporting surface.

In one embodiment, the steering of the vehicle is remotely controlled by signals from a transmitter to a receiver and associated servo motors, speed controllers and batteries mounted within the spherical vehicle. In another embodiment, the steering is controlled by pumping fluid between two chambers mounted within the vehicle to thereby change the center of gravity of the vehicle. In yet another embodiment, the suspended mass includes a person seated in the vehicle whereby the center of gravity and hence direction of travel is manually controlled.

BRIEF DESCRIPTION OF THE DRAWINGS

FIG. 5 is a side elevational view partly in section of an embodiment of the present invention illustrating the details of construction for remotely controlling the steering and speed system;

FIG. 6 is a fragmentary view taken along line 6—6 of FIG. 5;

FIG. 7 is a schematic of the remote control system employed in the embodiment of FIGS. 5 and 6;

FIG. 8 is a side elevational view partly in section of another embodiment of the present invention;

FIG. 9 is a side elevational view partly in section of yet another embodiment of the present invention; and FIG. 10 is a front elevational view partly in section of the embodiment shown in FIG. 9.

DESCRIPTION OF THE PREFERRED EMBODIMENTS

Figure 1:
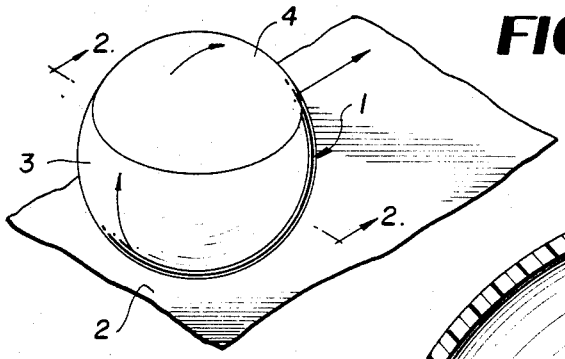
FIG. 1 is a perspective view of the spherical vehicle of the present invention.
Figure 2:
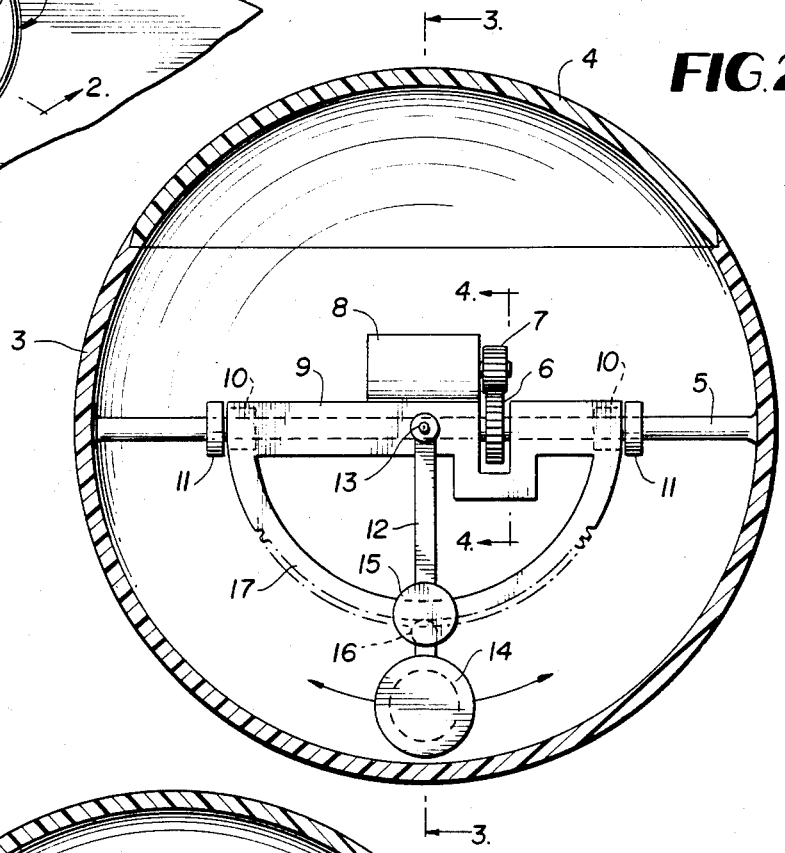
FIG. 2 is an enlarged view of the vehicle taken along line 2—2 of FIG. 1.

Referring to the drawings and more particularly to FIG. 1 thereof, the spherical vehicle 1 of the present invention is adapted to roll on a supporting surface 2 and includes a spherical shell 3 having a removable top portion 4 which facilitates access to the interior of the shell containing the driving and steering components shown in FIG. 2. The drive assembly comprises a shaft or axle 5 extending diametrically across the interior of the shell and having its ends rigidly secured to the inner wall thereof. A gear 6 is secured to the shaft 5 and is adapted to be driven by a pinion gear 7 connected to the drive shaft of a motor 8. The motor 8 is mounted on a frame assembly 9 journaled on the shaft 5 by suitable bearings 10 and collars 11 are secured to the shaft 5 to keep the frame 9 centered on the shaft 5. When the motor 8 is energized, the pinion 7 will drive gear 6 which in turn drives the axle 5 to thereby cause the spherical vehicle 1 to roll on a supporting surface. Since the frame 9 is journaled on the axle 5, it will not rotate with the axle but will remain oriented in a vertical plane.

Figure 3:
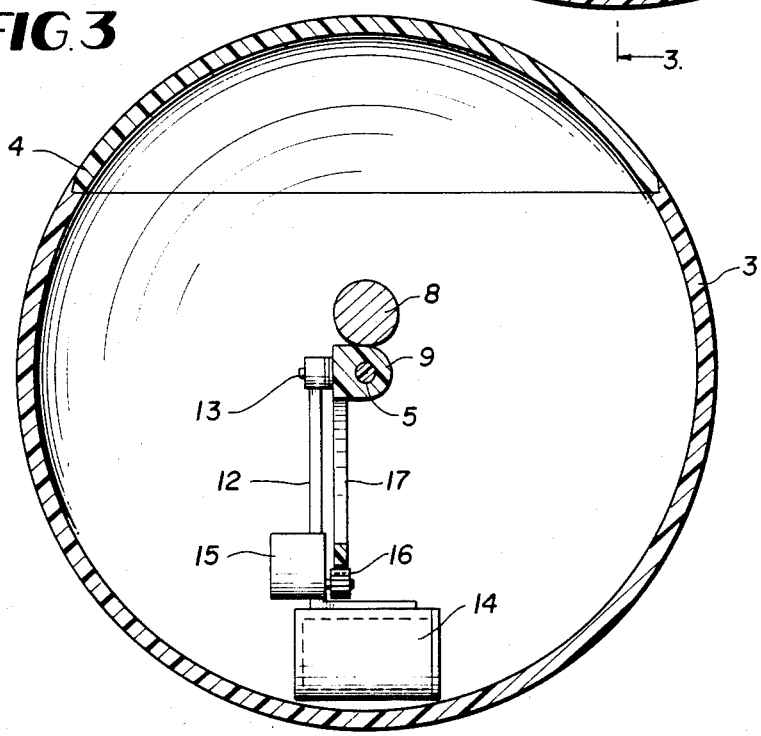
FIG. 3 is a view taken along line 3—3 of FIG. 2.
Figure 4:
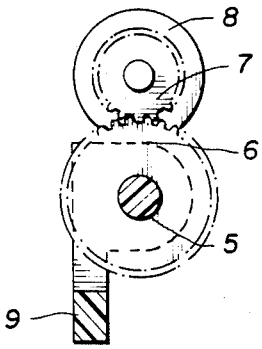
FIG. 4 is a view taken along line 4—4 of FIG. 2.

The steering assembly for the vehicle comprises a pendulum arm 12 pivotally connected as at 13 to the frame 9, the lower end of the arm 12 having a mass 14 connected thereto, the center of the mass being in the plane containing the axle 5. A servo motor 15 is also mounted on the pendulum arm 12 and as will be seen in FIG. 3, a gear 16 is connected to the servo motor drive shaft and meshes with a gear segment 17 integrally connected to the frame 9 and depending therefrom. By this construction and arrangement, when the servo motor 15 is energized, the gear 16 meshing with gear segment 17 will cause the pendulum 12, 14 to move in the direction of the arrows, depending upon the direction of rotation of the servo motor drive shaft, to thereby shift the center of gravity of the vehicle, whereby its direction of travel will be changed. The drive motor 8 and servo motor 15 can be electric motors and the pendulum mass 14 can include batteries for energizing the motors.

The speed of the motor 8 and the direction of rotation of the servo motor 15 can be remotely controlled by a radio transmitter-receiver system wherein a receiver may be positioned within the spherical shell 3 and operatively connected to the servo motor 15 and drive motor 8, the receiver being responsive to signals from a transmitter actuated by an operator in a location remote from the vehicle. Such an arrangement is shown in FIGS. 5 and 6, which is similar to the embodiment shown in FIGS. 2 and 3 in that the motor 8 is mounted on the frame 9 which is journaled on the axle 5 driven by gear 6 meshing with drive pinion 7. The pendulum arm 12 includes a pair of servo motors 15 mounted thereon and, instead of the pendulum pivot 13 and gear segment 17 shown in FIG. 2, the drive shafts 18 of the servo motors 15 are integrally connected to a pair of plates 19 rigidly connected to the frame 9; thus, the servo motor drive shafts 18 form the pivot point for the pendulum arm 12. The remaining components of the control system within the vehicle are mounted on the pendulum arm or frame 12 and include a receiver 20, a speed controller 21, speed control power drive 22, drive motor batteries 23, and receiver and servo motor batteries 24, the control system being completed by a transmitter 25 actuated by a person outside the vehicle. The components employed in the radio control system for steering the vehicle of the present invention are standard components used today for the remote control of toy vehicles.

Another embodiment for steering the vehicle by changing the center of gravity is illustrated in FIG. 8 wherein a pair of receptacles 26, 27 containing a fluid 28 are suspended from the frame 9. A pipe 29 extends between the receptacles and includes a motor driven pump assembly 30, whereby the fluid can be transferred from one receptacle to another, to thereby change the center of gravity of the vehicle and thus the direction of travel thereof. It will be understood by those skilled in the art that the radio control system described in connection with the embodiment of FIGS. 5 and 6 can also be used to control the drive motor 8 and motor pump assembly 30.

While the embodiments of the vehicle of the present invention described hereinabove in connection with FIGS. 2 to 8 have been concerned with the remote control of the vehicle, the concept of continuously steering a spherical vehicle while it is rolling on a supporting surface can also be employed when the spherical shell 3 is made large enough to accommodate a person, as shown in FIGS. 9 and 10. In this embodiment, the pendulum arm 12 is pivotally connected to the frame as at 13. A suitable chair or bucket seat 31 having a tubular frame is rigidly connected to the lower end of the arm. An arcuate frame 32 is secured to the frame 9 and depends therefrom to form a handle for a person 33 seated in the chair 31. The drive motor 8 and pulley-belt drive assembly 34 are positioned outboard of the center of the sphere; accordingly, a conterweight 35 is secured to the opposite end of the frame 9. In use, the motor 8 and associated pulley-belt drive assembly 34 drives axle 5 to cause the sphere 3 to roll on a supporting surface. Steering of the vehicle is accomplished by the operator 33 grasping the arcuate handle 32 and passing it hand-over-hand to cause the pendulum arm 12 to move about pivot 13 to thereby change the center of gravity of the vehicle. The mass for the pendulum is provided by the chair 31, the operator 33 and the motor power source 36 which can be batteries if the motor 8 is electric or fuel, if the motor is an internal combustion engine. The shell 3 in this embodiment would either be transparent or of an open framework construction to afford the operator clear visibility.

It is to be understood that the forms of the invention herewith shown and described are to be taken as preferred examples of the same, and that various changes in the shape, size and arrangement of parts may be resorted to, without departing from the spirit of the invention or scope of the subjoined claims.

We claim:

1. A spherical vehicle control system comprising, a spherical shell adapted to roll on a supporting surface, an axle extending diametrically across the interior of said shell, the ends of said axle being rigidly connected to the inner surface of said shell, frame means mounted on said axle, motor drive means mounted on said frame means and operatively connected to said axle for rotating said axle and associated spherical shell to thereby cause said shell to roll on a supporting surface, said frame means being journaled on said axle whereby said frame means remains in a vertical plane during rotation of said shell, mass means, means suspending said mass means from said frame means so that it is movable in a plane containing said axle, and control means operatively connected to said mass means for changing the position of said mass means by moving it toward one end of said axle or toward the other end thereof during the rolling motion of said shell, to thereby shift the center of gravity of said shell, whereby continuous steering of the vehicle is accomplished during the rolling thereof.

2. A sperical vehicle control system according to claim 1, wherein the motor drive means comprises a motor mounted on said frame, a gear mounted on the output shaft of said motor, and a gear secured to said axle meshing with said motor pinion gear.

3. A spherical vehicle control system according to claim 1, wherein the motor drive means comprises a motor mounted on said frame, and a pulley-belt drive assembly mounted between said motor and said axle.

4. A spherical vehicle control system according to claim 1, wherein the mass means comprises, a pendulum connected to said frame means, said pendulum including an arm pivotally connected at one end to said frame means and weight means mounted on the opposite end of said arm, and servomotor means mounted on said pendulum arm, said servomotor means having drive means operatively connecting it to said frame means, whereby upon actuation of said servomotor means the weight means is caused to move in an arcuate path about the pivotal connection of said arm.

5. A spherical vehicle control system according to claim 4, wherein said drive means includes a gear segment suspended from said frame means, a drive gear connected to the servomotor means drive shaft and meshing with said gear segment.

6. A spherical vehicle control system according to claim 4, the motor drive means including an electric motor and the servomotor means comprises at least one electric motor, and the weight means includes batteries for the servomotor means and electric drive motor means.

7. A spherical vehicle control system according to claim 1, wherein the mass means comprises a pair of fluid-containing receptacles suspended from said frame means, a fluid transfer pipe extending between said receptacles, and a pump assembly connected to said pipe for transferring fluid from one receptacle to another.

8. A spherical vehicle control system according to claim 4, wherein the servomotor means comprises a pair of oppositely facing servomotors, each servomotor having a drive shaft fixedly connected to said frame means, said servomotor drive shafts forming the pivotal connection of said pendulum arm to said frame means.

9. A spherical vehicle control system according to claim 6, wherein the control means comprises a radio control system including a receiver mounted on said pendulum arm, said receiver being electrically connected to said servomotor means, a speed control power drive mounted on said pendulum arm and connected to said electric drive motor, and a speed controller mounted on said pendulum arm and connected to said receiver and said speed control power drive, and a transmitter for sending signals to said receiver from a remote location, whereby the speed and direction of travel of the spherical vehicle can be remotely controlled.

* * * * *